US008684179B2

(12) United States Patent
Weissbrod

(10) Patent No.: US 8,684,179 B2
(45) **Date of Patent: *Apr. 1, 2014**

(54) INSERT HAVING A REINFORCEMENT FOR CONTAINER PACKAGING

(75) Inventor: Paul A. Weissbrod, South Euclid, OH (US)

(73) Assignee: Lincoln Global, Inc., City of Industry, CA (US)

( * ) Notice: Subject to any disclaimer, the term of this patent is extended or adjusted under 35 U.S.C. 154(b) by 209 days.

This patent is subject to a terminal disclaimer.

(21) Appl. No.: 13/116,449

(22) Filed: May 26, 2011

(65) Prior Publication Data

US 2012/0297739 A1 Nov. 29, 2012

Related U.S. Application Data

(60) Continuation-in-part of application No. 12/855,144, filed on Aug. 12, 2010, now Pat. No. 7,975,847, which is a division of application No. 12/435,068, filed on May 4, 2009, now Pat. No. 7,854,323, which is a division of application No. 11/967,669, filed on Dec. 31, 2007, now abandoned.

(51) Int. Cl.
*B65D 85/26* (2006.01)

(52) U.S. Cl.
USPC ..... 206/443; 206/591; 206/814; 428/36.91

(58) Field of Classification Search
CPC ..... B65D 58/26
USPC ..... 428/34.1, 371, 36.91; 206/443, 380, 206/814, 591; 267/166
See application file for complete search history.

(56) References Cited

U.S. PATENT DOCUMENTS

| | | | | |
|---|---|---|---|---|
| 3,887,077 | A | 6/1975 | Frey | |
| 4,497,407 | A | 2/1985 | Stager | |
| 4,840,831 | A | 6/1989 | Schraven et al. | |
| 7,780,004 | B2 | 8/2010 | Carlozzi et al. | |
| 7,854,323 | B2 | 12/2010 | Weissbrod | |
| 2002/0190451 | A1 * | 12/2002 | Sancaktar et al. | 267/166 |
| 2004/0173613 | A1 | 9/2004 | Schroeder et al. | |

(Continued)

FOREIGN PATENT DOCUMENTS

| | | | |
|---|---|---|---|
| AU | 2004100057 | A4 | 4/2004 |
| CN | 1067206 | A | 12/1992 |

(Continued)

OTHER PUBLICATIONS

International Search Report for application PCT/IB2012/001027 dated Sep. 6, 2012.

(Continued)

*Primary Examiner* — Alexander Thomas
(74) *Attorney, Agent, or Firm* — Hahn Loeser & Parks LLP

(57) ABSTRACT

A container insert for taking up extra space may be placed in a container intended for storage and/or shipment of material to an end user. The insert may be generally longitudinal having a helical configuration that may be expanded and constricted for taking up different volumes of space within the container respective of the amount of material stored therein. The insert may also be elastically deformable or generally pliable and may absorb impact forces for preventing or minimizing damage to the material. Further, the insert may include at least one reinforcement, including at least one wire or metal strip, or portions thereof.

27 Claims, 7 Drawing Sheets

(56) References Cited

U.S. PATENT DOCUMENTS

| | | | |
|---|---|---|---|
| 2009/0165428 | A1 | 7/2009 | Weissbrod |
| 2009/0205290 | A1 | 8/2009 | Weissbrod |

FOREIGN PATENT DOCUMENTS

| | | | |
|---|---|---|---|
| DE | 3930336 | A1 | 3/1991 |
| GB | 1057211 | A | 2/1967 |
| JP | 2003146360 | A | 5/2003 |

OTHER PUBLICATIONS

Written Opinion of International Searching Authority issued with the IRS for application PCT/IB2012/001027 dated Sep. 6, 2012.

* cited by examiner

INSERT HAVING A REINFORCEMENT FOR CONTAINER PACKAGING

INCORPORATION BY REFERENCE AND CROSS-REFERENCE TO RELATED APPLICATIONS

This application incorporates by reference in its entirety each of the following: U.S. utility patent application Ser. No. 11/967,669 filed on Dec. 31, 2007, now abandoned and; U.S. utility patent application Ser. No. 12/435,068, filed on May 4, 2009, now U.S. Pat. No. 7,854,323, which issued Dec. 21, 2010. Additionally, this application is a continuation-in-part application of and claims priority to U.S. utility patent application Ser. No. 12/855,144, filed on Aug. 12, 2010, now U.S. Pat. No. 7,975,847, which issued Jul. 12, 2011, which was a divisional application of U.S. utility patent application Ser. No. 12/435,068, filed on May 4, 2009, now U.S. Pat. No. 7,854,323, which issued Dec. 21, 2010, which was a divisional application of U.S. utility patent application Ser. No. 11/967,669, filed on Dec. 31, 2007, now abandoned.

TECHNICAL FIELD

The present invention pertains to methods and devices for packing materials in a container, and more particularly, methods and devices for tightly packing rod-like material in a canister.

BACKGROUND OF THE INVENTION

Countless products are packaged and shipped to end-users in this country and around the globe every day. Many products are placed in crates or boxes and filled with packing material to minimize or prevent damage during shipping. In some circumstances, products are wrapped with layers of plastic material encapsulated with air, known commonly as bubble wrap, which helps protect the product from shock or impact. Other containers are filled with packing materials made from polymers expanded into foam through the use of heat, typically in the form of steam. Polystyrene is an example of one such type of polymer. These air filled "peanuts" also function to protect the packaged products by absorbing force thereby minimizing damage to the surrounding article.

Some products are stored and packaged in canisters, which may be sealed to prevent the enclosed items from exposure to ambient conditions. Some canisters are hermetically sealed to prevent exposure to air and/or humidity, which may oxidize or otherwise damage the contents. Such containers help preserve the freshness of the packaged items. Examples of packaged products range from edible substances to industrial consumables. In many cases, the same or similarly sized canisters are used to package different quantities of materials. For a particular quantity of product, extra space remaining in the canister may allow the product to jostle about during shipment providing opportunity for individual articles to collide with each other and the walls of the canister thereby increasing the likelihood of damage.

One particular example of packaged articles relates to welding consumables, and more specifically welding electrodes. Stick welding is a common welding process. The process utilizes a finite length welding rod that is consumed by establishing an arc between the electrode and the work piece. The electrodes function best when stored in air tight containers. Usually, one size of container stores a variety of welding rod types where differences in density translate into one welding rod that is more loosely or tightly packed than another. Extra space within the container often causes damage to the welding rods as its coating is prone to fracture when the welding rods collide with each other during shipment.

It would be useful to incorporate a packing insert that takes up the volume of extra space in the container without regard to how much material is stored inside. However, packing material, such as that mentioned above, is not practical for use in these types of application. It is a laborious process to insert bubble wrap, particularly into a canister, without damaging or puncturing the inflated cells. Moreover, when deflated, the cells of the bubble wrap are rendered useless in filling up the excess space. Foamed polymers are subject to the same result. Moreover, this type of packing material tends to crumble and cling to the contents of the canister requiring the user to clean off debris with each rod removed.

What is needed is a packing insert having a reinforcement that automatically adjusts to the amount of product stored in a container. The packing insert should be easy to apply and should minimize the damage of the container articles due to jostling. The embodiments of the subject invention obviate aforementioned problems.

BRIEF SUMMARY

In accordance with the present invention, there is provided a system for packaging associated material that includes associated material including at least one welding rod, a container having one or more wall members containing the associated material, and a means for packing the associated material in the container. The means for packing includes at least one reinforcement means and is coiled storing elastic energy and substantially tightly packing the associated material with respect to the one or more wall members.

Also within the scope of the invention is a system for packaging associated material including associated material, a container having one or more wall members containing the associated material, and means for packing the associated material in the container, wherein said means for packing includes at least one reinforcement means. The said means for packing includes at least one reinforcement means expands radially and is coiled storing elastic energy and radially substantially tightly packing the associated material with respect to the one or more wall members The associated material is radially disposed between said means for packing and the one or more wall members.

Also within the scope of the invention is another system for packaging associated material. The system includes associated material, a container having one or more wall members containing the associated material, means for packing the associated material in the container, and an informational paper within said means for packing. The means for packing includes at least one reinforcement means and is coiled storing elastic energy and substantially tightly packing the associated material with respect to the one or more wall members.

These and other objects of this invention will be evident when viewed in light of the drawings, detailed description and appended claims.

DETAILED DESCRIPTION OF THE DRAWINGS

Figure 1:
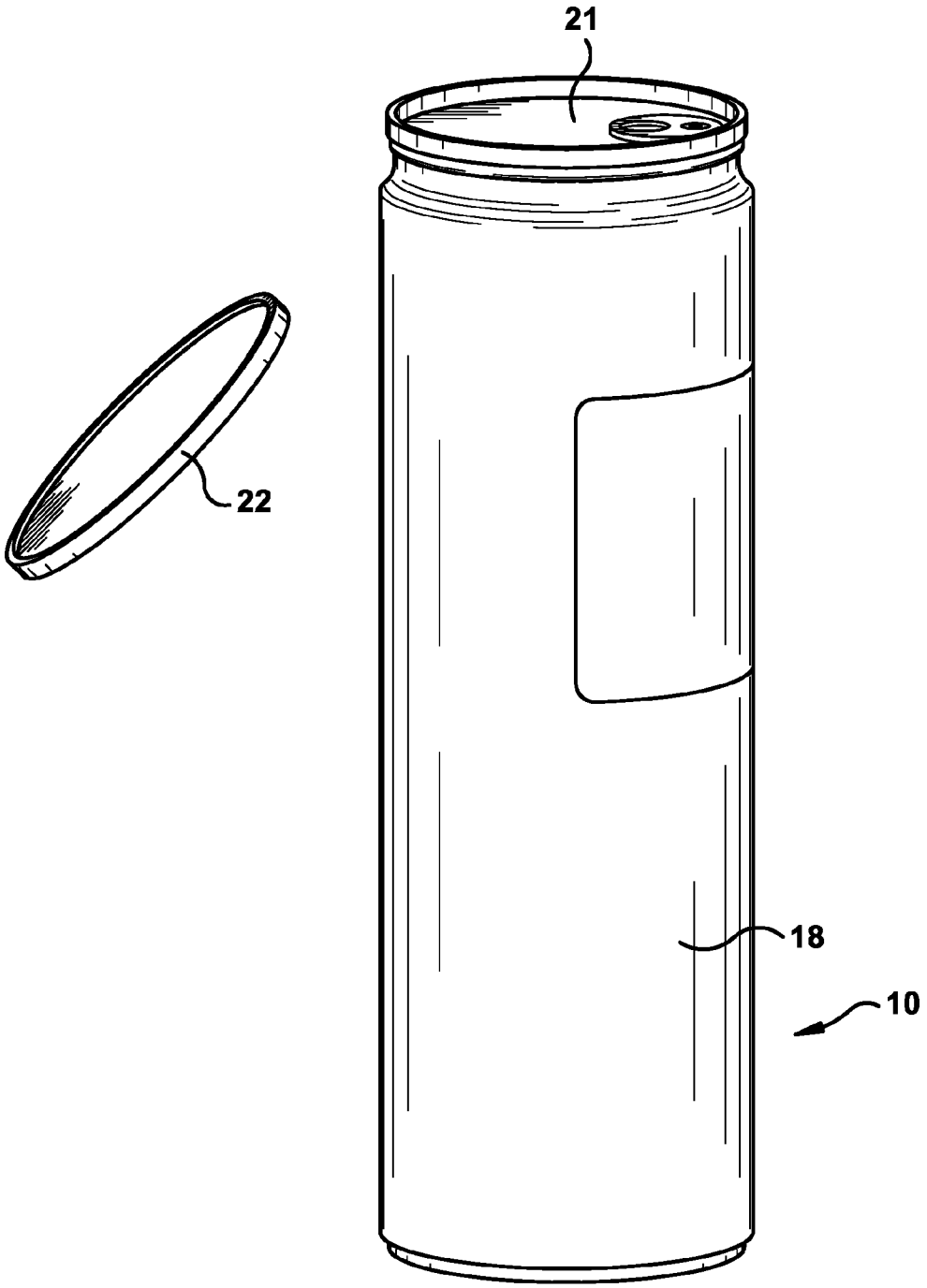
FIG. 1 (Prior Art)
FIG. 1 is a perspective view of a prior art container for storing and/or transporting articles according to the embodiments of the invention.

Referring now to the drawings wherein the showings are for purposes of illustrating embodiments of the invention only and not for purposes of limiting the same, FIG. 1 shows a prior art container for holding various articles, depicted generally at 10. The container 10 may be used to package a plurality of articles 14, shown in FIG. 2, for storage and/or transportation purposes. As such, the container 10 may be generally rigid. In one embodiment, the container 10 may be a cylindrical receptacle constructed from metal or metal alloy. Other embodiments contemplate a boxlike container 10. This type of container 10 may be constructed from rigid or semi rigid material. However, persons of ordinary skill in the art will readily understand the application of the embodiments of the subject invention to any size, shape and/or material used to construct the container 10. By way of example, the figures depict a generally cylindrical canister 18. The canister 18 may be used to hold rod-like articles, such as for example, welding rods 15. However, the type of articles 14 contained by the canister 18 are not to be construed as being limited to welding materials or even rod shaped articles. Rather any type of article 14 may be stored in the canister 18 as is appropriate for use with the embodiments of the subject invention. In the current embodiment, the canister 18 may be hermetically sealed with a pop-open tabbed cap or seal 21. Sealing the canister 18 in this manner helps to preserve the articles 14 stored within the canister 18 from exposure to ambient conditions. A reclosable cap 22 (see FIG. 1) may also be provided for subsequently sealing the contents of the canister 18 after the seal 21 (see FIG. 2) has been removed.

Figure 2:
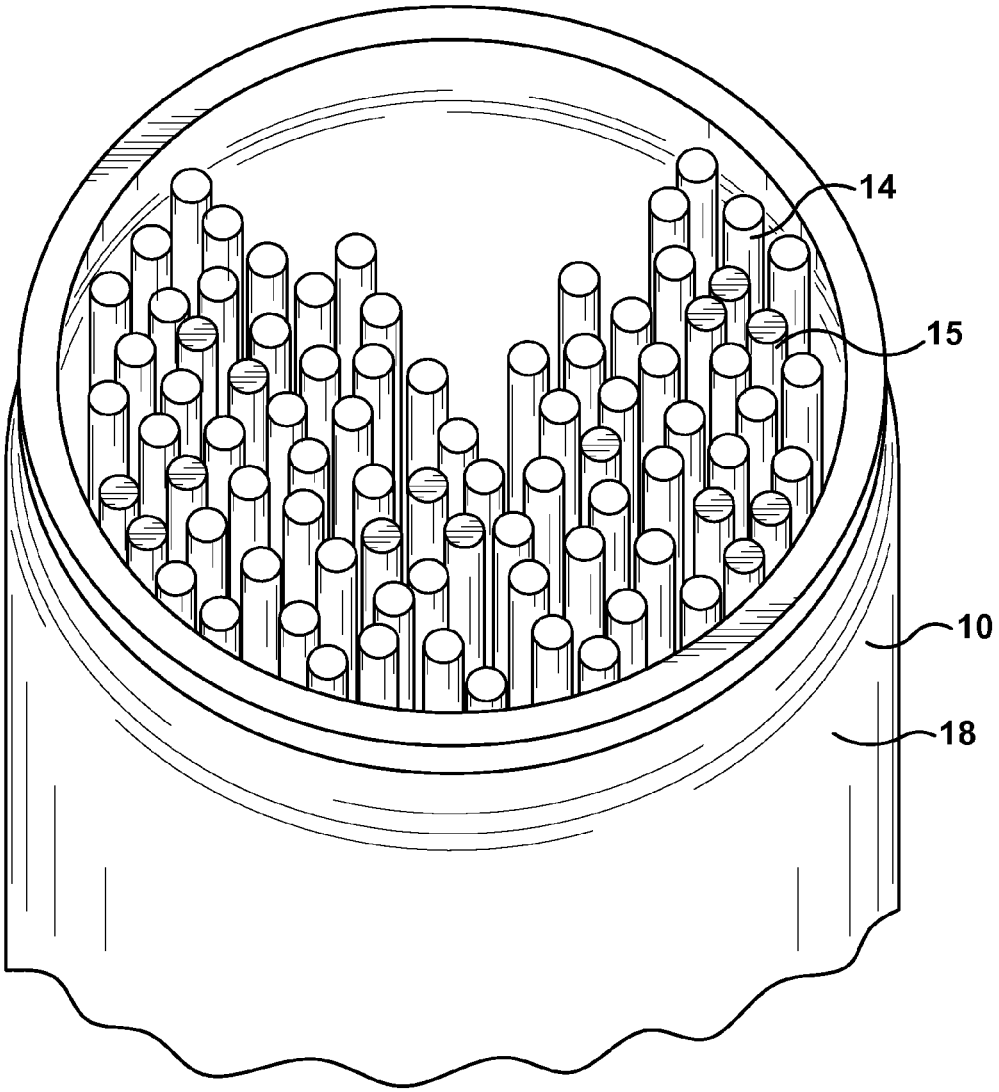
FIG. 2 (Prior Art)
FIG. 2 is a close up perspective view of a prior art open container storing one or more articles according to the embodiments of the invention.

FIG. 2 depicts a plurality of rod-like articles 14 stored within the container 10 in the prior art. In certain applications, the container 10 may be utilized to store a particular amount of material, which may be measured in terms of weight. For example, ten (10) pounds of a particular type of welding rod 15 may be designated for storage in the container 10. It will be readily understood that one type of welding rod 15 may have a substantially different density than another type of welding rod. Accordingly, ten (10) pounds of a first type of welding rod 15 will result in a different quantity than a second type of welding rod. In either case, the same kind of container 10 may be used to store both types of welding rod 15. It follows that different volumes of empty space may therefore reside within the container 10 depending on the type, or density, of material stored therein. Without the use of an insert, welding rod 15 stored within the container 10 may be banged or knocked against the sides of the container 10, as well as other welding rods 15, resulting in damage to the articles. Accordingly, a container insert 27, shown in FIG. 3, may be installed to effectively take up the volume of empty space within the container 10. It is noted that the container insert 27 may fill up the empty space within the container 10 irrespective of the quantity or type of material being stored in the container 10, as will be discussed in the following paragraphs.

Figure 3:
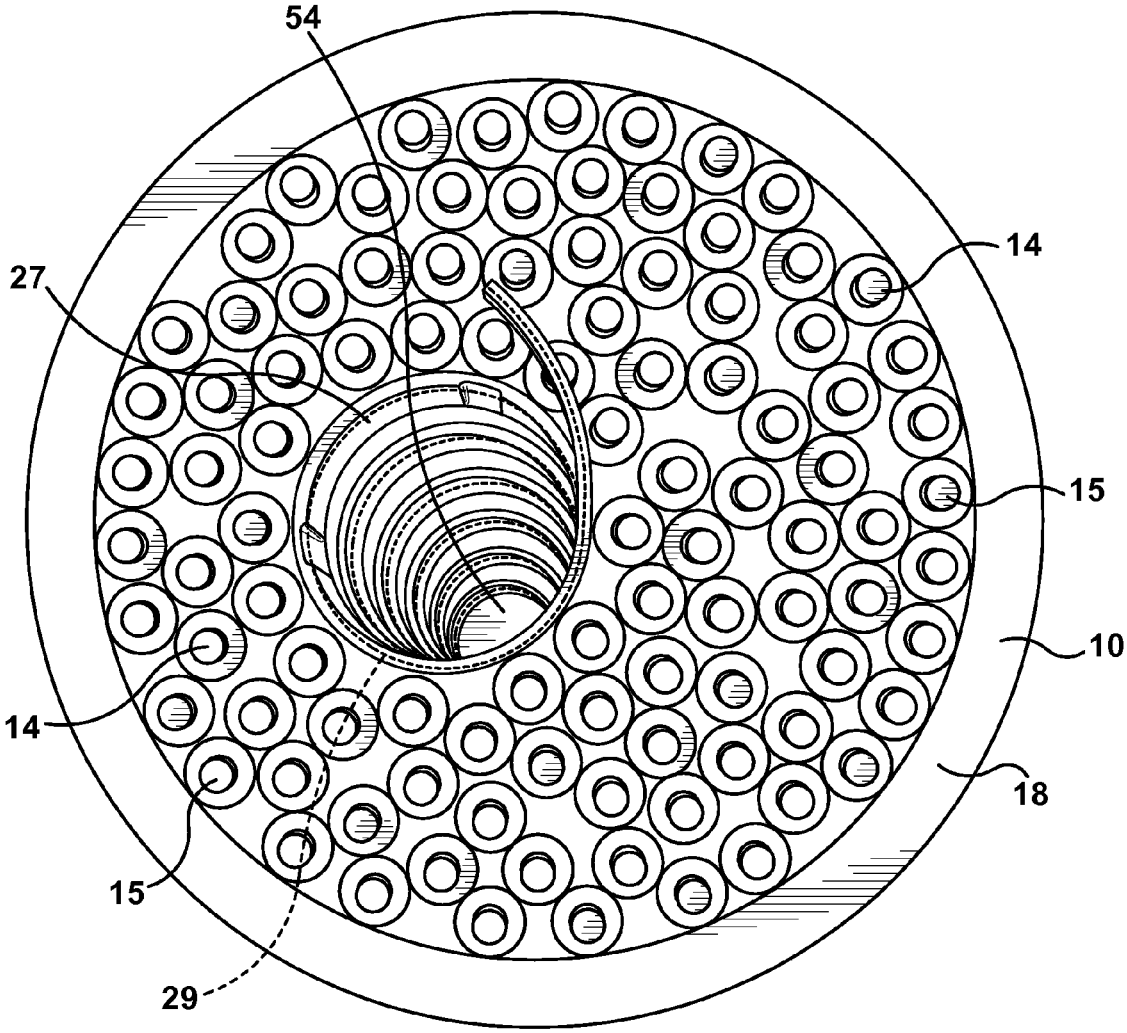
FIG. 3 is a close up perspective view of an open container storing one or more articles and an insert having a reinforcement for taking up additional space within the container according to the embodiments of the invention.

With reference now to FIG. 3, a plurality of articles 14 are shown packed into the canister 18. It is noted that the articles 14, which may be welding rods 15 or any other articles suitable for storage in the canister 18, are tightly packed with respect to the sides of the canister 18 and with respect to the other articles 14. A container insert 27 having reinforcement 29 (illustrated in ghost lines) is also shown inserted between the plurality of articles 14. Reinforcement 29 is discussed in further detail below. The container insert 27 may function to take up space in the canister 18 not filled by the articles 14 resulting in little or no gaps disposed between the welding rods 15. In one embodiment, the container insert 27 may be capable of automatically expanding or contracting for taking up different volumes of space. In the case of fewer articles 14, the insert 27 may expand its circumference, thereby filling up a greater volume of space. Conversely, for a greater number of articles 14, the container insert 27 may contract as constrained by the articles 14 and/or the sides of the container 10. In this manner, the container insert 27 may automatically conform to the volume of space in the canister 18 not taken up by the articles 14. It will be appreciated that a tightly packed canister 18 will minimize the detrimental effects of the articles 14 bumping or knocking into each other and the side walls of the canister 18 during transportation or shipment. In the exemplary case of welding rod 15, the impact of one welding rod 15 with that of another may cause the coating on the welding rod 15 to break loose rendering the rod unusable for welding. The container insert 27 may also absorb shock as may be experienced during transportation or shipment. Accordingly, the insert 27 may be a generally pliable insert 27 being elastically deformable, i.e. able to retain its original shape after being subjected to force as will be discussed further below.

Figure 4:
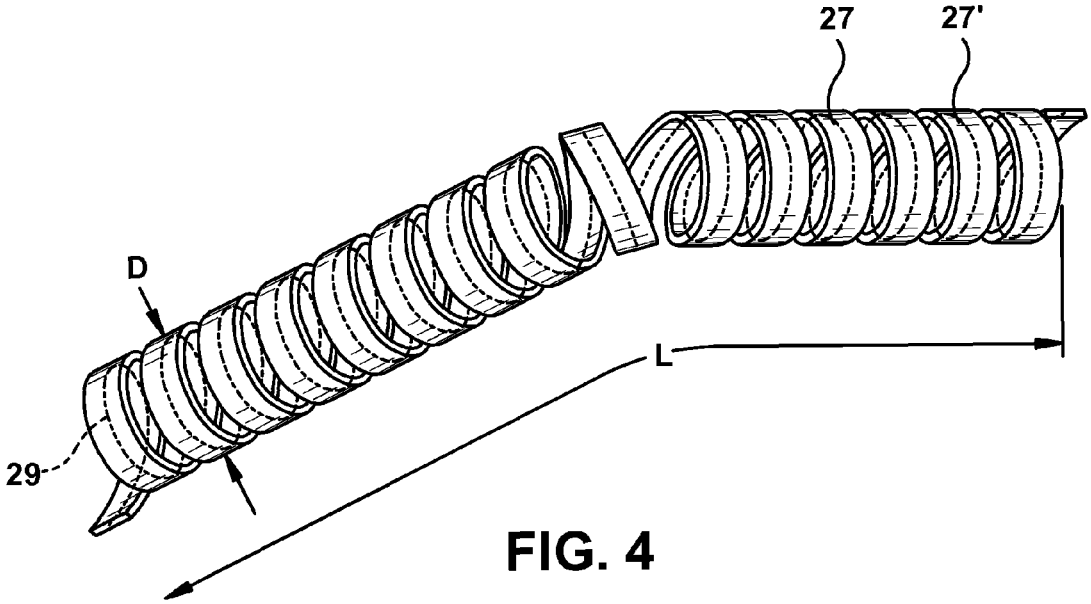
FIG. 4 is a close up perspective view showing one embodiment of an internally reinforced container insert according to the embodiments of the invention.

With reference to FIGS. 3 and 4, the container insert 27 having reinforcement 29 may function to store potential energy for tightly packing the articles 14 in the container 10. The potential energy may be in the form of elastic energy, as mentioned above. The amount of elastic energy stored in the container insert 27 may be a function of the configuration of the container insert 27. In one embodiment, the container insert 27 may be helical. Other embodiments include adjacently formed elastic fingers joined to a common spine. However, it is to be construed that the container insert 27 may have any configuration as is appropriate for storing potential energy used to tightly pack the articles 14 into the container 10. Potential elastic energy may also be a function of the type of material from which the container insert 27 is made. Materials having stronger molecular bonds may possess greater potential for storing elastic energy. All such material types and configurations are to be construed as being included within the scope of coverage of the embodiments of the subject invention.

With continued reference to FIG. 4, the container insert 27 may be a contiguously formed unitary device. In one embodiment, the container insert 27 may have a circular cross section possessing a characteristic diameter. The container insert 27 may also be generally longitudinal having a length corresponding to the height of the container 10. Accordingly, the container insert 27 may be substantially the same height as the container 10. Alternatively, the container insert 27 may be shorter than the height of the container 10 into which it is being inserted. In this manner, as the length of the container insert 27 expands, it will not extend beyond the ends of the container 10. However, any longitudinal dimension of the container insert 27 may be chosen with sound engineering judgment. The container insert 27 may be constructed from a polymer material such as a thermoplastic. Polypropylene is one exemplary type of thermoplastic material that may be used to construct the container insert 27 having elastic properties suitable for use with the embodiments described herein. Still, the container insert 27 may be constructed from any type of material as is appropriate for use with the embodiments of the subject invention including but not limited to polymers, fibrous materials, metals, alloys and the like. Container inserts may be made from an extrusion machine, co-extrusion machine, and the like. In another embodiment, container inserts may be extruded from two or more materials that have the same or different thermal coefficients of expansion.

With reference again to FIG. 4, the container insert 27 may be constructed having a generally curved configuration, which may be a helical configuration thereby termed a helix or helical insert 27'. In this example, the material of the helix 27' may be fashioned into a spiral, contiguously formed progressively along a longitudinal axis. The helix 27' may function to resist being deformed or constricted by the contents of the container 10 and as a result pushes against the container's contents thereby tightly packing the articles 14 therein. It will be readily seen that the container insert 27 is flexible and generally capable of expanding and contracting radially, as well as longitudinally. In a first unrestricted state, the container insert 27 may have a characteristic diameter D and a characteristic length L as determined by the configuration of the container insert 27 when initially formed. The spirals of the container insert 27 therefore define a volumetric region derived from the diameter D and the length L. It is noted that the first unrestricted state may comprise a maximum of the range of volumes that container insert 27 may fill. In a second constricted state, the spirals of material may be wound more tightly thereby defining a smaller volumetric region. It will be appreciated that the second constricted state may be infinitely variable between the maximum and a minimum diameter, of which the minimum diameter may relate to the thickness of the material used to construct the container insert 27. Persons of ordinary skill in the art will understand that the spring-like properties of the material comprising the container insert 27 will allow its configuration to automatically adjust responsive to the amount of material stored in the container 10. For a container insert made from two or more materials that have different thermal coefficients of expansion, container insert may have a first material formed into a helical shape and at least a second material having a greater thermal coefficient of expansion that forms on top of the first material in the helical shape. The second material may tend to increase the diameter of the helical shape as temperature increases and decrease the diameter as the temperature decreases because of its greater thermal coefficient of expansion.

Figure 5:
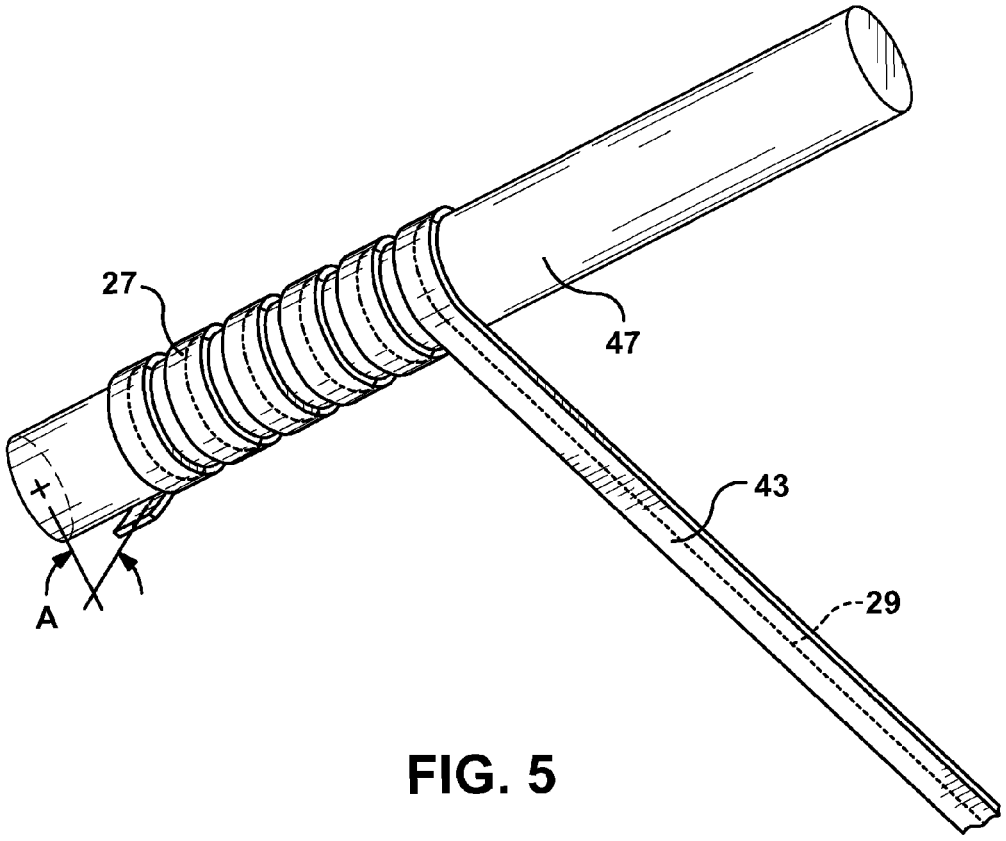
FIG. 5 is a perspective view of a container insert having an internally reinforced insert being wound on a core according to the embodiments of the subject invention.

With reference now to FIGS. 4 and 5, in one embodiment, the container insert 27 having reinforcement 29 may be constructed from a contiguously formed strip of material 43. As previously mentioned, the strip of material 43 may be comprised of a polymer material such as may be extruded in a process well known in the art. The strip of material 43 may be generally flat having a rectangular cross section. However, other cross sectional configurations of material may also be utilized including but not limited to: circular, oval, or square. In fact any configuration of material may be used to construct the container insert 27 as is appropriate for use with the embodiments of the subject invention. The strip of material 43 may be wound onto a core 47 at an acute angle A thereby allowing the material 43 to wrap around the core in a coiled fashion. It is noted that the strip of material 43 may be wound at any angle without departing from the intended scope of coverage of the embodiments of the subject invention. Additionally, any diameter or cross section of the core 47 may be used to fashion the container insert 27 thereby determining the container insert's 27 potential to store elastic energy and its capability to tightly pack the articles 14 in the container 10. In this way, the container insert 27 may automatically expand and contract in the spring-like manner described above. During installation, the container insert 27 may be wound tightly with respect to a centerline axis, inserted into the container can and subsequently allowed to automatically expand thereby packing the articles tightly in the container 10. It is noted here that other processes may be utilized to construct the container insert 27 including injection molding, lamination, and the like. However, any process may be used without limiting the scope of coverage of the embodiments of the subject invention.

With reference now to FIGS. **6*a*-6*k*, top perspective views of alternative embodiments of container insert 27 are illustrated, wherein container insert 27 is substantially similar to container insert 27 discussed above, except container insert 27 in FIGS. 6*a*-6*k* may have at least one reinforcing wire 29 or metal strip 32 and container insert 27** may have a noncontiguous form. The configurations of the reinforcements (discussed below) may provide bending stresses, torsional stresses, or both types of stresses depending on whether the reinforcement has a straight or non-straight reinforcement design. For example, straight reinforcements may at least produce bending stresses and curvilinear or non-straight reinforcements may at least produce torsional stresses.

Figure 6A:
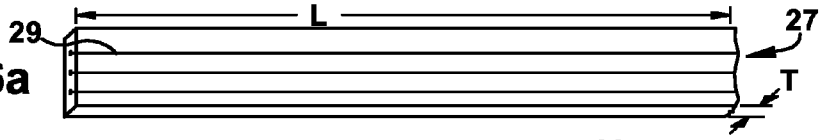
FIGS. 6*a*-6*k* are top perspective views of alternative reinforcement inserts.
Figure 6B:
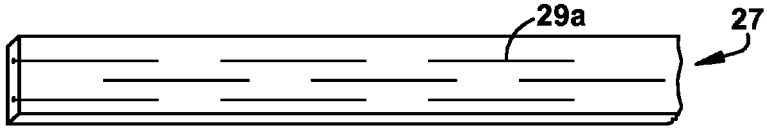
Figure 6C:
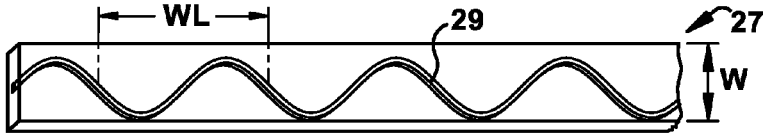
Figure 6D:
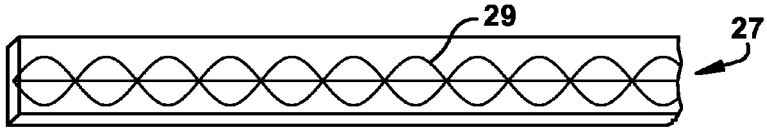
Figure 6E:
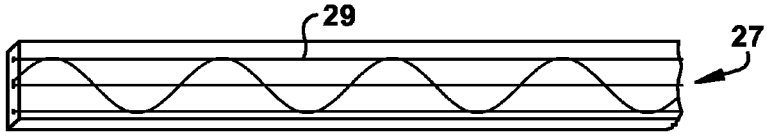
Figure 6F:
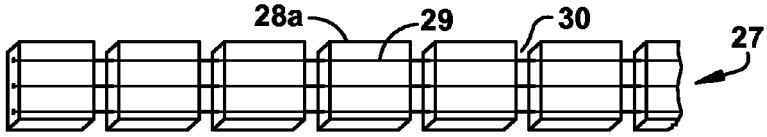
Figure 6G:
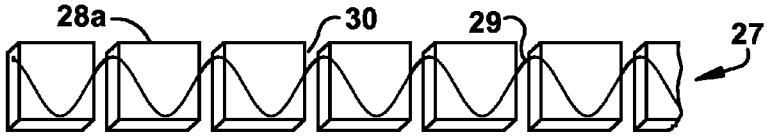
Figure 6H:
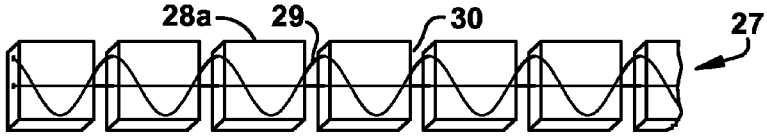
Figure 6I:
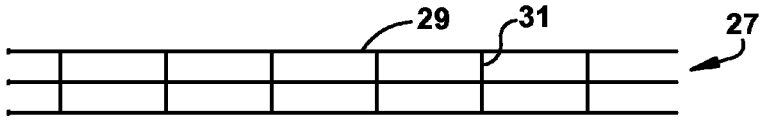
Figure 6J:
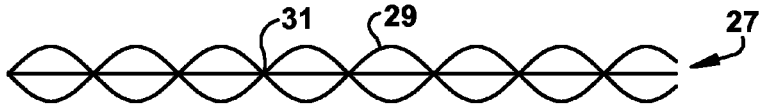
Figure 6K:
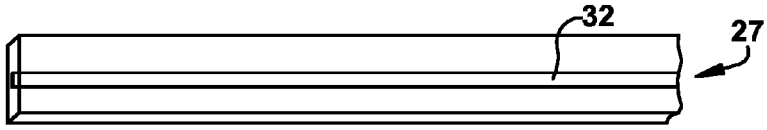

The reinforcing wires in FIGS. **6*a*-6*j* and the metal strip in FIG. 6*k* are shown in solid lines for clarity, although they are preferably below the surface of the container insert. FIG. 6*a* illustrates a top perspective view of container insert 27 having contiguously formed plastic and three reinforcing wires 29 that extend straight and that are laterally separated along length L of container insert 27. In the illustrated embodiment, container insert 27 has a rectangular cross section and reinforcing wires 29 have circular cross sections. In another embodiment (not shown), the number of wires in the container insert can be more or less than what is illustrated in FIG. 6*a***. In yet another embodiment, at least two wires may not be laterally separated for at least a portion of the length of the container insert. In another embodiment, the wires can have a cross section other than circular, including but not limited to oval, and the wires can have any gauge or diameter. In yet another embodiment, the container insert can have another cross section, including but not limited to square, circular, and oval. In another embodiment, reinforcing wire or metal strip can be continuously or discontinuously embedded or partially embedded in the container insert.

In the illustrated embodiment, reinforcing wire 29 is made from spring tempered material, for example spring tempered wire or piano wire. Spring tempered materials like spring tempered wire has a tendency to return to its original shape after bending or twisting, e.g., helically coiled, as long as the elastic limit of the wire is not exceeded. In other words, the material has shape memory. Container insert 27 having reinforcing wire 29 made from spring tempered steel that is bent or twisted will provide greater outward pressure, relative to a container insert without a reinforcing wire, because the reinforcing wire has the tendency to return to its original straight shape after it is formed into a non-straight shape. The reinforcing wire may add elastic energy storage capacity to the container insert and facilitate radial expansion of the reinforcement wire and insert when the insert is formed into a non-straight shape. Further, the reinforcing wire may reduce localized buckling of at least a portion of the container insert, e.g., one or more loops. For example, container insert 27 having a reinforcing wire 29 formed into a helical coil will unwind into a larger diameter helical coil as a user consumes articles from the container. In another embodiment (not shown), the wire can be made from blue tempered spring steel or cold rolled annealed spring steel. In yet another embodiment, the wire can be made from other materials, including a non-exhaustive and non-limiting list of metals and metallic alloys, including but not limited to at least one of the following: carbon steel, stainless steel, chrome vanadium alloy steel, chrome silicon alloy steel and the like.

In the illustrated embodiment, container insert 27 has a thickness T and each reinforcing wire 29 may be positioned in about the center of the thickness. In another embodiment, at least one wire may be in another position that is above or below the center of the thickness. In another embodiment, at least one wire is at least partially on an external surface of the container insert.

FIG. 6*b* illustrates a top perspective view of container insert 27 having a plurality of reinforcing wire portions 29*a* that intermittently extend straight and that are laterally separated along length L of container insert 27. In another embodiment (not shown), at least one wire continuously extends along the length of the container insert. In yet another embodiment, at least two reinforcing wire portions make contact with each other in at least one location along the length of the container insert. In another embodiment, wire portions intermittently extend straight along the length L of the container insert, wherein at least one wire portion may be at an angle relative to a line (not shown) that is parallel with the length of the container insert.

FIG. 6*c* illustrates a top perspective view of container insert 27 having one reinforcing wire 29 that extends along the entire length of the container insert in a curvilinear or nonlinear pattern, e.g., a repeating wave. In the illustrated embodiment, reinforcing wire 29 has a square cross section. The curvilinear or nonlinear pattern of wire 29 includes at least one wave length WL that has an amplitude (not shown) that is about one-half the width W of container insert 27. In another embodiment (not shown), container insert may include at least one wire having another nonlinear pattern, including a square wave or a triangular wave. In yet another embodiment, the amplitude of the at least one wave length may be less than one-half the width of container insert. In another embodiment, container insert may include a reinforcing wire having a wave length WL that is more or less than what is illustrated in FIG. 6*c*.

Illustrated in FIGS. 6*d*-6*e*, container insert 27 includes at least one reinforcing wire 29 extending straight along length L of container insert 27 and at least one reinforcing wire 29 extending along length L of container insert 27 in a repeating curvilinear wave pattern. Container insert 27 in FIG. 6*d* includes one reinforcing wire 29 that extends straight along length L of the container insert and two reinforcing wires 29 that extend along the length of the container insert in a repeating curvilinear wave pattern, e.g., two sine waves. In the illustrated embodiment, the three wires cross the path of each other (viewed from the top) in at least one location. Container insert 27 in FIG. 6*e* includes three reinforcing wires 29 that extend straight and laterally spaced along the entire length L of the container and one reinforcing wire 29 that extends along the entire length of the container insert in a repeating curvilinear wave pattern.

Illustrated in FIGS. 6*f*-6*h*, container insert 27 may have a noncontiguous form and have at least two insert portions 28*a* separated by gap 30. Spanning across each gap 30 is at least one reinforcing wire 29 that securedly links each insert portion 28*a* to at least one other insert portion 28*a*. Container insert 27 in FIG. 6*f* includes six insert portions 28*a*, five gaps 30, and three reinforcing wires 29, wherein reinforcing wires 29 extend straight and laterally spaced along length L of container insert 27. Container insert 27 in FIG. 6*g* includes six insert portions 28*a*, five gaps 30, and one reinforcing wire 29 that extends along length L of the container in a repeating wave pattern. Container insert 27 in FIG. 6*h* includes six insert portions 28*a*, five gaps 30, one reinforcing wire 29 that extends straight along length L of container insert 27, and one reinforcing wire 29 that extends along length L of container insert in a repeating wave pattern. In another embodiment (not shown), container insert can include more or less than the number of insert portions and/or gaps illustrated in FIGS. 6*f*-6*h*. In yet another embodiment (not shown), at least one reinforcing wire does not span the entire length of the container insert.

Illustrated in FIGS. 6*i*-6*j*, container insert 27 may be made from at least one reinforcing wire 29 or at least one metal strip. Container inserts 27 illustrated in FIGS. 6*i*-6*j* do not include a contiguously formed unitary portion or a noncontiguously formed portion made from plastic. FIG. 6*i* illustrates a top perspective view of container insert 27 having three circular reinforcing wires 29 that extend straight and that are laterally spaced along the length L of container insert 27. Container insert 27 further includes a plurality of securing wires 31 that laterally extend and securedly attach to each of the three wires 29. In another embodiment (not shown), the number of linearly and laterally spaced wires and/or the number of securing wires that container insert includes may be more or less than what is illustrated in FIG. 6*i*. In yet another embodiment (not shown), at least two wires may not be laterally spaced for at least a portion of the length of the container insert. In another embodiment (not shown), the wires may have a cross section other than circular, including but not limited to an oval. In another embodiment, the wires can have any gauge or diameter that one skilled in the arts can configure. In yet another embodiment (not shown), the securing wires may securedly attach to a subset of the reinforcing wires.

FIG. 6*j* illustrates a top perspective view of container insert 27 having three circular reinforcing wires 29, including at least one reinforcing wire that extends straight to form length L of container insert and two reinforcing wires that extend along length L of container insert 27 in a repeating curvilinear wave pattern. The container insert 27 illustrated in FIG. 6*j* may be referred to as a braided container insert. In the illustrated embodiment, securing wires 31 securedly attach or bundle the three reinforcing wires 29 together in at least one location. In another embodiment, container insert includes at least one reinforcing wire that extends straight and forms length L of container insert and at least one wire that extends along the length of the container insert in a repeating nonlinear or curvilinear wave pattern. In another embodiment, container insert may include at least one wire in another nonlinear pattern, including a square wave, a triangular wave, or an irregular wave pattern. In yet another embodiment, the number of wave lengths in the wave pattern may be less than or more than what is illustrated in FIG. 6*j*.

FIG. 6*k* illustrates a top perspective view of container insert 27 having at least one reinforcing metal strip 32 made from spring tempered steel. In the illustrated embodiment, metal strip 32 extends straight along the entire length of container insert 27. Metal strip 32 has a rectangular cross section. In another embodiment (not shown), container insert may include more than one metal strip. In yet another embodiment, container insert may include metal strip portions that may extend straight and laterally spaced along the length of the container insert. In another embodiment, metal strip portions intermittently extend straight along the length of the container insert, wherein at least one metal strip portion may be at an angle relative to a line (not shown) that is parallel with the length of the container insert. In yet another embodiment, reinforcing metal strip has a cross section that includes but is not limited to an oval cross section. In another embodiment (not shown), reinforcing metal strip is made from a non-exhaustive and non-limiting list of metals and metallic alloys identified previously.

Figure 7:
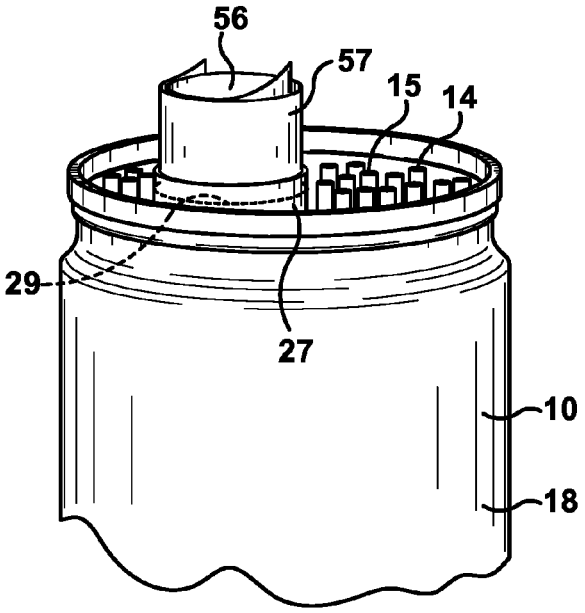
FIG. 7 is a perspective view of a container having a reinforced insert and an accessory placed within an interior region of the insert.

With reference again to FIG. 3 and now to FIG. 7, it will be readily seen that the interior of the container insert 27 may be generally hollow. This hollow region of space 54 may remain segregated as the container insert 27 having a reinforcement 29 holds the articles 14 or welding rods 15 tightly against the sides of the container 10. In one embodiment, it is contemplated that the generally hollow region 54, shown in FIG. 3, inside may be used to store one or more items or accessories 57 associated with the articles 14 placed in the container 10. Operating instructions 56, which may be a pamphlet, are one example of a type of accessory 57 that may be placed into the hollow region 54 with the articles 14 for storage and/or transportation to the end user. A MSDS (Material Safety Data Sheet) is another example of an item, or accessory 57, that may be placed in the hollow region 54. The items may comprise verbiage printed on generally light and flexible paper. As such, an accessory 57 of this type will not affect the function of the container insert 27 nor will it detrimentally impact the container's contents. It is expressly noted here that accessories 57 of this type are exemplary in nature and are not to be construed as limiting. Rather any type of accessory 57 may be placed into the hollow region 54 that will not detrimentally effect the function of the container insert 27 or the condition of the articles 14.

Figure 9:
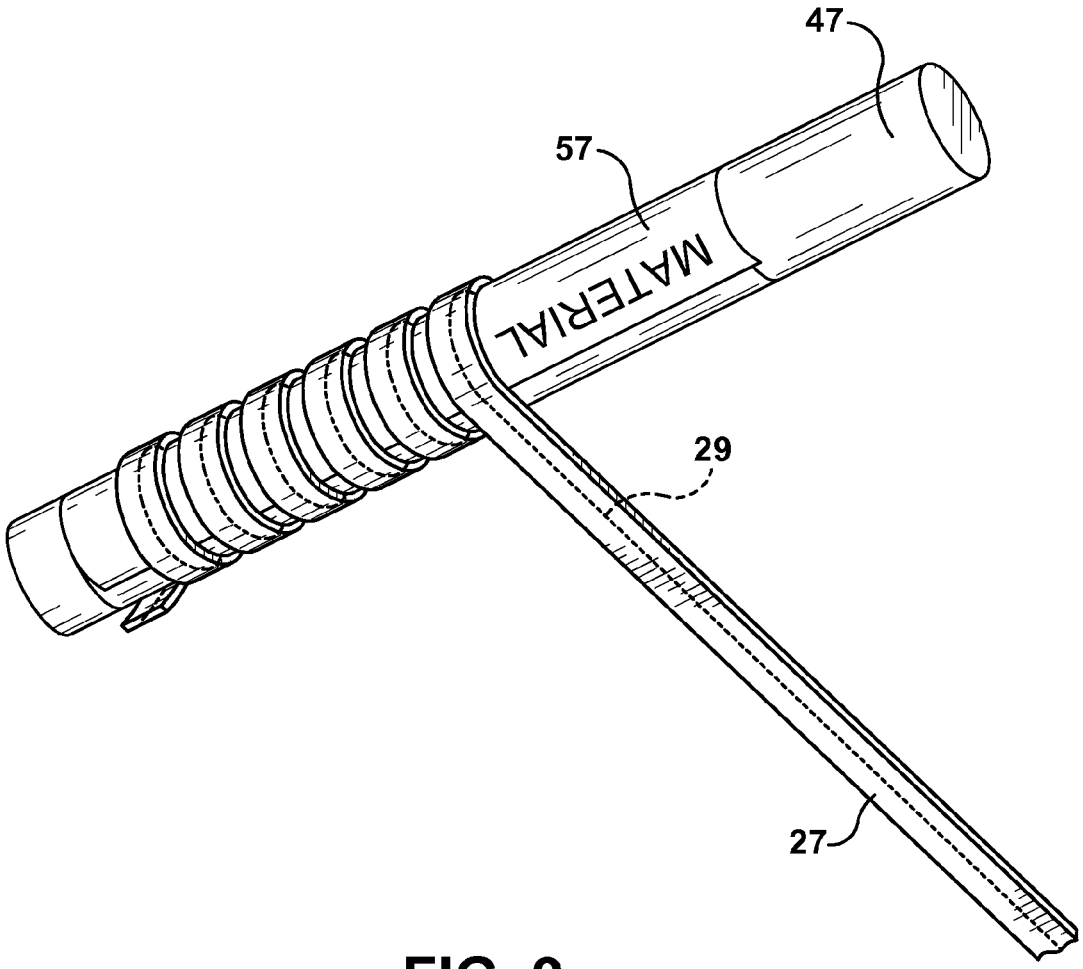
FIG. 9 is a perspective view of an accessory and a reinforced container insert being wound on a core according to the embodiments of the subject invention.

With reference now to FIG. 9, as mentioned above it may be necessary or desirable to provide information to the end user regarding the contents of the container 10. Such information, like for example safety data, may be presented to the end user directly upon opening the container 10. Typically, safety data is printed on paper that can be placed within the hollow region 54 as described above. In certain circumstances, it may be necessary to ensure that the information presented is clearly seen by the end user and free from obscurity. Accordingly, an accessory 57, which in the current example is a Material Safety Data Sheet, may be placed within the container 10 and positioned proximate to the container opening for presentation to the end user when the container 10 is opened. The accessory 57 may be inhibited from moving within the container 10 by one or more means to make certain that the end user sees the item. In one embodiment, the accessory 57 may be affixed to the container insert 27 near the opening of the container 10. Clips or hooks may be utilized to hold the accessory 57 firmly in place such that when the container insert 27 having a reinforcement 29 is removed from the container 10, the accessory 57 is removed at the same time. This presents the accessory 57 to the end user prior to removing and using the container contents. It is contemplated that the container insert 27 may be constructed having recesses or notches contoured to receive the accessory 57 and/or the fasteners. However, any manner and/or configuration of forming the container insert 27 to receive an accessory 57 may be chosen with sound engineering judgment.

In another embodiment, an adhesive may be used to adhere the accessory 57 to the container insert 27. The adhesive may be a tacky re-adherable substance such as that developed by the 3M Corporation. Alternatively, the adhesive may comprise fast-holding glue or tape. However, it is to be construed that any type or form of adhesive may be utilized as is appropriate for use with the embodiments of the subject invention. The adhesive may be applied to the container insert 27 and/or the container 10. More specifically, the adhesive may be applied to one or more of the container insert surfaces where after the accessory 57 may be adhered to the container insert 27. In one embodiment, the adhesive may be applied to the container insert 27 prior to fashioning or coiling the container insert 27. In this case, the accessory 57 may first be wrapped around the core 47 and the container insert 27 subsequently formed around the core 47 in a manner consistent with the embodiments described herein. It will be appreciated that re-adherable adhesive will allow the end user to easily remove the accessory 57 without damage. Alternatively, the accessory 57 may be adjoined to the container insert 27 after the container insert 27 has been formed or coiled. Still, any manner of attaching the accessory 57 to the container insert 27 may be chosen without limiting the intended scope of coverage of the embodiments of the present invention. In this way, the accessory 57 is held in unobstructed view by the end user until removed from the container 10. This ensures that the end user is presented with the Material Safety Data Sheet or other accessory 57 at the time of opening the container 10.

The accessory 57 may be affixed or adhered to something other than or in addition to the container insert 27, like for example the sides of the container 10 or the container lid. In this embodiment, the accessory 57 may be attached to the tabbed cap or seal 21 using an adhesive, or other means. When the end user opens the container 10 by pulling on the cap 21, the adhesive applied between the accessory 57 and the cap 21 pulls the accessory 57 from within the hollow region 54 and immediately presents the accessory 57, e.g. the Material Safety Data Sheet, to the end user. It is noted that any type or manner of applying adhesive substances between the accessory 57, container insert 27 and/or the cap 21 may be chosen as is appropriate for use with the embodiments of the subject invention.

Figure 8:
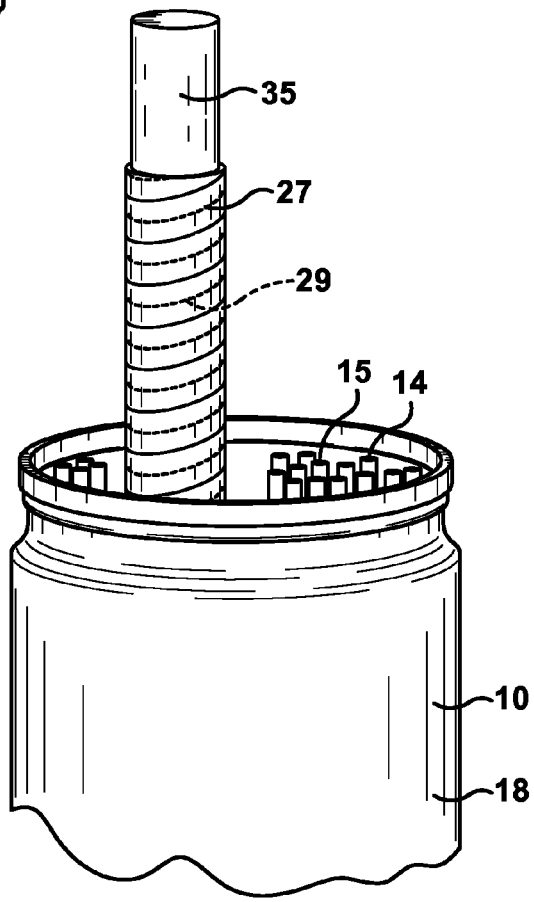
FIG. 8 is a perspective view showing the reinforced container insert being inserted into a container.

With reference now to all of the figures but especially to FIG. 8, operation of the container insert 27 will now be described. The container 10 may be filled with a designated number of articles 14. The number of articles 14 may accumulatively take up a percentage of the volume as defined by the side walls and ends of the container 10 leaving free space between the articles 14. A container insert 27 may then be tightly wound onto an insertion member 35 having a diameter sufficiently small enough to fit within the volume of free space in the container 10. While holding the container insert 27 tightly against the insertion member 35, the operator may push both items, i.e. the container insert 27 and the insertion member 35, in between the articles 14 stored in the container 10. Subsequently releasing the container insert 27 will cause the helix 27' to expand against the sides of the articles 14 and/or the walls of the container 10 thereby tightly packing the articles 14 within the container 10. Accessories 57 may then be subsequently placed into the hollow region 54 of the container insert 27. The container 10 may then be closed or sealed for storage and/or transportation as desired. As the container 10 is banged or jolted during transportation movement of the articles 14 back and forth will be minimized by the container insert 27. Additionally, shock or impact forces translated into the container 10 may be absorbed by the elastic deformation and constriction of the container insert 27. After the inertia has dissipated, the elasticity of the container insert 27 will expand its circumference thereby taking up the free space within the container 10.

The invention has been described herein with reference to the preferred embodiment. Obviously, modifications and alterations will occur to others upon a reading and understanding of this specification. It is intended to include all such modifications and alternations insofar as they come within the scope of the appended claims or the equivalence thereof.

What is claimed is:

1. A system for packaging associated material, comprising:
associated material including at least one welding rod,
a container having one or more wall members containing the associated material; and,
means for packing the associated material in the container, wherein said means for packing includes at least one reinforcement means and is coiled storing elastic energy and substantially tightly packing the associated material with respect to the one or more wall members; and wherein
said at least one reinforcement means is at least partially embedded within said means for packing.

2. The system as defined in claim 1, wherein
said means for packing at least automatically expands responsive to the amount of associated material stored in the container.

3. The system as defined in claim 1, wherein
said at least one reinforcement means comprises at least a first portion of elastically deformable material.

4. The system as defined in claim 3, wherein
the at least a first portion of elastically deformable material comprises a band of thermoplastic material, and wherein
said at least one reinforcement means includes at least one of the following: a wire and a metal strip made from spring tempered material.

5. The system as defined in claim 4, wherein
said band is contiguously formed and said reinforcement is in at least one of the following configurations: straight, curvilinear, and braided.

6. The system as defined in claim 1, wherein
said band is noncontiguous and includes at least one gap, and wherein the at least one reinforcement is in at least one of the following configurations: straight, curvilinear, and braided.

7. The system as defined in claim 1, wherein
the container is hermetically sealed and is a cylindrical receptacle.

8. The system as defined in claim 7, wherein
said means for packing further includes a helical configuration having a longitudinal axis substantially parallel to a longitudinal axis of the container.

9. The system as defined in claim 1, wherein
said means for packing further includes a helical configuration having a longitudinal axis substantially parallel to a longitudinal axis of the container.

10. A system for packaging associated material, comprising:
associated material,
a container having one or more wall members containing the associated material; and,
means for packing the associated material in the container, wherein said means for packing includes at least one reinforcement means and expands radially and is coiled storing elastic energy and radially substantially tightly packing the associated material with respect to the one or more wall members, wherein the associated material is radially disposed between said means for packing and the one or more wall members; and wherein
said at least one reinforcement means is at least partially embedded within said means for packing.

11. The system as defined in claim 10, wherein
said at least one reinforcement means comprises at least a first portion of elastically deformable material that includes a band of thermoplastic material.

12. The system as defined in claim 11, wherein
said at least one reinforcement comprises at least one of the following: a wire and a metal strip made from spring tempered material.

13. The system as defined in claim 11, wherein
said band of thermoplastic material is contiguously formed and said at least one reinforcement comprises at least two wires that are laterally separated.

14. The system as defined in claim 11, wherein
said band of thermoplastic material is contiguously formed and
said at least one reinforcement comprises at least two noncontiguous wire portions that extend along a length of the band, and wherein
said at least two noncontiguous wire portions are laterally separated.

15. The system as defined in claim 11, wherein
said band of thermoplastic material is contiguously formed, and wherein
said reinforcement comprises at least one wire that is straight and at least one wire that is curvilinear.

16. The system as defined in claim 11, wherein
said band of thermoplastic material is contiguously formed and wherein
said reinforcement comprises at least two of the following in a braided configuration: at least one wire and at least one metal strip.

17. The system as defined in claim 11, wherein
said band of thermoplastic material is noncontiguously formed and
said reinforcement comprises at least two wires that are laterally separated.

18. The system as defined in claim 10, wherein
said means for packing that includes at least one reinforcement has a helical configuration having a longitudinal axis substantially parallel to a longitudinal axis of the container that expands responsive to the amount of associated material stored in the container.

19. The system as defined in claim 10, wherein
said means for packing further comprises at least two wires extending along a length to form a wire band and at least one securing wire.

20. A system for packaging associated material, comprising:
associated material;
a container having one or more wall members containing the associated material;
means for packing the associated material in the container, wherein said means for packing includes at least one reinforcement means and is coiled storing elastic energy and substantially tightly packing the associated material with respect to the one or more wall members; and wherein
said at least one reinforcement means is at least partially embedded within said means for packing, and
an informational paper within said means for packing.

21. The system as defined in claim 20, wherein said means for packing automatically expands responsive to the amount of associated material stored in the container.

22. The system as defined in claim 20, wherein said at least one reinforcement means comprises at least a first portion of elastically deformable material.

23. The system as defined in claim 22, wherein the at least a first portion of elastically deformable material comprises a band having at least a first portion of thermoplastic material.

24. The system as defined in claim 23, wherein said band further comprises at least one gap.

25. The system as defined in claim 20, wherein said means comprises a coil of material spirally configured with respect to a central axis.

26. The system as defined in claim 20, wherein said reinforcement means comprises at least one of the following: a wire and a metal strip made from spring tempered material.

27. The system as defined in claim 20, wherein said means for packing has a helical configuration having a longitudinal axis substantially parallel to a longitudinal axis of the container.

* * * * *